US009297122B2

(12) United States Patent
Bösterling et al.

(10) Patent No.: US 9,297,122 B2
(45) Date of Patent: Mar. 29, 2016

(54) GUIDE PLATE FOR A SYSTEM FOR FASTENING A RAIL TO A SUBSTRATE, AND A SYSTEM COMPRISING A GUIDE PLATE OF THIS TYPE

(75) Inventors: Winfried Bösterling, Neuenrade (DE); Lutz Rademacher, Lüdenscheid (DE); Farhad Esfandiyari, Iserlohn (DE); Michael Steidl, Chicago, IL (US)

(73) Assignee: Vossloh-Werke GmbH, Werdohl (DE)

( * ) Notice: Subject to any disclaimer, the term of this patent is extended or adjusted under 35 U.S.C. 154(b) by 1216 days.

(21) Appl. No.: 12/703,421

(22) Filed: Feb. 10, 2010

(65) Prior Publication Data

US 2010/0200666 A1 Aug. 12, 2010

Related U.S. Application Data

(63) Continuation-in-part of application No. PCT/EP2009/051588, filed on Feb. 11, 2009.

(51) Int. Cl.
*E01B 9/02* (2006.01)
*E01B 9/30* (2006.01)

(52) U.S. Cl.
CPC . *E01B 9/30* (2013.01); *E01B 9/303* (2013.01); *Y10T 29/53* (2015.01)

(58) Field of Classification Search
USPC ..... 238/264, 310, 312, 315–319, 338, 343, 238/379
See application file for complete search history.

(56) References Cited

U.S. PATENT DOCUMENTS

| | | | | |
|---|---|---|---|---|
| 4,313,563 | A | 2/1982 | Young | |
| 6,343,748 | B1 * | 2/2002 | Pilesi et al. | 238/310 |
| 6,651,897 | B1 * | 11/2003 | Porrill et al. | 238/310 |
| 7,992,798 | B2 * | 8/2011 | Bosterling et al. | 238/349 |
| 2004/0232254 | A1 * | 11/2004 | Kowalski | 238/264 |
| 2008/0179419 | A1 * | 7/2008 | Vives Clavel | 238/264 |

FOREIGN PATENT DOCUMENTS

| | | | | |
|---|---|---|---|---|
| DE | 4101198 | C1 | 3/1992 | |
| WO | 9415022 | A1 | 7/1994 | |
| WO | WO 9415022 | A1 * | 7/1994 | E01B 9/28 |

* cited by examiner

*Primary Examiner* — R. J. McCarry, Jr.
(74) *Attorney, Agent, or Firm* — The Webb Law Firm

(57) ABSTRACT

The invention relates to a guide plate for a system for fastening a rail to a substrate on which there is provided, laterally of the railway track, a shoulder, which absorbs the forces occurring when the rail is traveled on by a rail vehicle, the guide plate having an underside which is associated with the substrate and an upper side which is exposed in the installation position, is remote from the underside and on which it is possible to support a spring element provided for applying resiliently elastic holding-down forces to the rail to be fastened.

22 Claims, 6 Drawing Sheets

GUIDE PLATE FOR A SYSTEM FOR FASTENING A RAIL TO A SUBSTRATE, AND A SYSTEM COMPRISING A GUIDE PLATE OF THIS TYPE

CROSS REFERENCE TO RELATED APPLICATION

This application is a continuation-in-part of International Patent Application No. PCT/EP2009/051588, filed Feb. 11, 2009, which is herein incorporated by reference in its entirety.

BACKGROUND OF THE INVENTION

1. Field of the Invention

The invention relates to a guide plate for a system for fastening a rail to a substrate on which there is provided, laterally of the railway track, a shoulder which absorbs the forces which are produced when a rail vehicle travels on the rail. The guide plate has in this case an underside which is associated with the substrate and an upper side which is exposed in the installation position, is arranged remote from the underside and on which it is possible to support a spring element provided for applying resiliently elastic holding-down forces to the rail to be fastened.

In addition, the invention relates to a system for fastening a rail to a substrate on which there is provided, laterally of the railway track, a shoulder. The system according to the invention comprises in this case a spring element for exerting an elastic holding-down force on the rail, a guide plate for guiding the spring element and a tensioning element for bracing the spring element against the substrate.

2. Prior Art

In systems of this type, the object of the guide plates is, on the one hand, to absorb the forces occurring when the rail is traveled on and are directed transversely to the rail longitudinal direction and to transmit them to the shoulder which is securely fixed to the substrate. On the other hand, the guide plates serve as a rest for a respective spring element which exerts, when a rail fastening system equipped with the guide plate is fully installed, the required elastic holding-down force on the rail foot.

Guide plates known by the name "angled guide plates", such as for example that offered by the Applicant under the designation "W14", have a basic shape which, viewed from above, is rectangular and elongate and on one longitudinal side of which, associated with the rail, a guide surface is designed. When the guide plate is fully installed, this guide surface abuts fully against the rail foot and fixes the position of the rail in the transverse direction. In this case, the known angled guide plate has a through-opening which is oriented roughly centrally, extends from its upper side down to its underside and through which it is possible to pass during installation a fastening screw which braces the guide plate, with the spring element arranged thereon, against the substrate.

In addition to the prior art commented on hereinbefore, DE 41 01 198 C1 describes a guide plate intended for fastening a rail by means of a ω-shaped tensioning clamp. Depressions, in which the central part, which is bent in a U-shaped manner, of the tensioning clamp is positioned after installation, are provided in the known guide plate. In addition, the known angled guide plate has a flute extending parallel to the rail in the installation position. The outwardly leading portions of the tensioning clamp are supported in this flute after installation, longitudinally and transversely to the rail to be fastened in each case.

The known guide plates described hereinbefore presuppose the design of a shoulder in or on the respective substrate, on which shoulder the guide plate rests when installed. Conventionally, this shoulder is formed by a step which is moulded onto the substrate and against which the guide plate rests with its side remote from the rail when installed.

Another possibility of supporting a rail is described in U.S. Pat. No. 4,313,563. In this system for fastening a rail, which is also known by the name "Safelok", a shoulder piece, which is made from cast iron material, is cast into the fixed substrate which is generally formed from a concrete sleeper. This shoulder piece has, at its portion resting freely on the surface of the fixed substrate, a receptacle, the opening of which is arranged on the side of the step that is remote from the rail to be fastened.

In the Safelok system, a spring clip, which is shaped integrally from flat steel and has a crosspiece from which two spring arms running substantially parallel to each other emanate, engages into the recess of the shoulder. These spring arms are guided, viewed from the side, starting from the crosspiece positioned in the recess of the shoulder piece, in a large arc in the direction of the rail to be fastened, the spring arms ending, when untensioned, in a position arranged below the crosspiece. When installed, the spring arms press in a correspondingly pretensioned manner with their free ends onto the foot of the rail to be fastened, the upper side of which foot is located substantially at the same level as the receptacle of the shoulder.

The advantage of the Safelok system consists in the fact that it can be installed using a specially shaped tool. In practice, it has been found that, under the high loads resulting from heavy-load or high-speed traffic, force and spring excursion losses, as a result of which the spring force is greatly reduced, occur in the spring clips used in these systems within a short period of use. It can also occur that the spring clips are deformed during installation to the extent that they lose the spring properties required for properly holding down the rail. As a consequence of the decreasing spring action, the resistance to sliding-through of the rail foot in a direction directed to transversely to the longitudinal extension of the rail is also reduced.

A further disadvantage of the known the Safelok system, which has a particularly negative effect specifically in high-speed and heavy-load traffic, consists in the fact that in this system the rail is not protected against tilting which can occur, in particular, when high transverse forces occur. Finally, in the known Safelok system, the requirement for maximum possible insulation of the rail in relation to the substrate supporting it may be fulfilled only in a highly complex manner.

SUMMARY OF THE INVENTION

Against this background, the object of the invention was to provide a component allowing the requirements of modern rail travel operation to be met even in fastening systems of the type in which the forces occurring during travel operation are dissipated via a shoulder present on or in the fixed substrate.

In this case, the component to be provided by the invention should in particular be suitable to changeover in a simple manner existing fastening systems of the Safelok type in such a way that they reliably withstand the loads occurring in practice over a sufficiently long operating period.

The invention also seeks to provide a system for fastening a rail in which the disadvantages commented on hereinbefore no longer exist.

A guide plate according to the invention for a system for fastening a rail to a substrate on which there is provided, laterally of the railway track, a shoulder which absorbs the forces occurring when the rail is traveled on by a rail vehicle, has in accordance with the prior art commented on at the outset an underside which is associated with the substrate and an upper side which is exposed in the installation position and is remote from the underside. On the upper side of the guide plate, it is in this case also possible to support, as in the prior art discussed at the outset, a spring element provided for applying resiliently elastic holding-down forces to the rail to be fastened.

According to the invention, there is now shaped into the underside of the guide plate a recess, the dimensions of which are adapted to the dimensions of the shoulder in such a way that the shoulder engages freely into the recess in the installation position of the guide plate.

In addition, at least one reinforcing rib, which protrudes in the direction of the opening of the recess over a height which is less than the height of the recess, is designed at least on the roof surface of the recess that opposes the opening of the recess.

Through the recess shaped into the guide plate according to the invention from its underside, the guide plate can be placed onto the shoulder which is in each case present on the fixed substrate. The shoulder is in this case received by the recess in such a way that the guide plate itself is supported, with its standing surface remaining at the underside, on the fixed substrate.

If appropriate, one or more intermediate layers can in this case be provided between the underside of the guide plate and the fixed substrate in order, for example, to achieve a defined flexibility and a specific wear behaviour of the fastening point formed by the guide plate and the "spring element" and "tensioning element" components interacting therewith.

As a standard feature, the at least one reinforcing rib which is, in accordance with the invention, present in the receptacle, at the roof surface thereof, is dimensioned in such a way that, under optimum conditions in the attached, still-force-free state, there is a certain distance between the underside of said rib that is associated with the shoulder and the surface of the shoulder that is in each case associated therewith. If subsequently the spring element positioned on the guide plate is braced, the guide plate can undergo deformation until the rib is positioned on the shoulder and the roof portion of the guide plate, which roof portion covers the recess and carries the spring element, is supported on the shoulder. This reliably prevents excessive bending of the guide plate.

Should the reinforcing rib become fractured over the course of the bracing of the spring element, then this does not detract from the supporting function of said reinforcing rib, as in this case the guide plate is supported on the shoulder via the fragments remaining between the shoulder and the roof surface of the guide plate.

As a fracture of the reinforcing ribs present in each case is consciously allowed for, the reinforcing ribs are generally so narrow in their design as to be able to absorb only low transverse forces. Thus, the thickness of the reinforcing ribs is typically less than one fifteenth, in particular less than one twentieth, of the width of the guide plate as measured in the longitudinal direction of the rail to be fastened. Thus, in practice, the ribs are approx. 5 mm wide, whereas the guide plate is approx. 115 mm wide as measured in the rail longitudinal direction.

If the shoulder is not optimally positioned, because it for example juts out too high above the substrate, is positioned too deeply or is oriented obliquely, the fracture of the reinforcing rib is even brought about in a targeted manner during installation. This allows the free volume present in the receptacle to automatically adapt to the requirements resulting from the respective orientation and positioning of the shoulder without the installation process having to be interrupted for this purpose. This allows the guide plate to be supported securely on the shoulder present in or on the fixed substrate even when the shoulder is positioned imprecisely.

In this way, guide plates according to the invention allow, in a particularly lightweight design, the spring elements positioned thereon to be pretensioned with high forces without there being in this case the risk of a fracture of the guide plate. In this regard, a guide plate designed in accordance with the invention is particularly suitable for changing over existing fastening systems in which a corresponding shoulder is already provided in or on the respective fixed substrate. That is to say, as a result of the fact that the invention uses this shoulder to support the guide plate according to the invention and a guide plate according to the invention is in each case designed in such a way that its recess automatically adapts to the shape and position of the shoulder in question, the changing over can be carried out in a manner which is as simple as is conceivably possible and at accordingly minimised costs.

Two or more reinforcing ribs designed in the manner according to the invention can be provided in the recess of a guide plate according to the invention if, for example, this increases the secureness of the supporting and stiffening of the roof portion of the spring element, which roof portion covers the recess and carries the spring element when installed.

A system according to the invention for fastening a rail to a substrate on which there is provided, laterally of the railway track, a shoulder, comprises in accordance with the prior art specified at the outset a spring element for exerting an elastic holding-down force on the rail, a guide plate for guiding the spring element and a tensioning element for bracing the spring element against the substrate. The advantages of the configuration according to the invention of a guide plate, as summarised in a general manner hereinbefore, may be utilised in a system of this type in that its guide plate is designed in the manner according to the invention.

According to one embodiment of the invention, the guide plate has, at its front side associated with the rail to be fastened, a planar abutment surface for the rail foot. Via this abutment surface, the rail is supported against the transverse forces occurring when the rail is traveled on.

Advantageously, the at least one reinforcing rib provided in the receptacle of a guide plate according to the invention is oriented transversely to the abutment surface of the guide plate. In this way, the reinforcing rib not only supports the roof portion of the guide plate, which roof portion covers the receptacle and carries the spring element on its upper side, but stiffens the guide plate even in a direction oriented transversely to the longitudinal extension of the rail to be installed. Accordingly, despite the comparatively large-volume recess intended for receiving the shoulder, the guide plate is able to reliably absorb high transverse forces in the installation position.

Optimum supporting of the guide plate while at the same time effectively protecting the shoulder may be achieved in that the recess shaped into its underside is delimited, at its front associated with the rail and its back opposing the front and also the sides extending between the front and the back, in each case by a wall of the guide plate. This complete bounding of the recess by walls of the guide plate has a particularly positive effect when the shoulder is made from a material at a high risk of corrosion, for example cast iron or cast steel. In this embodiment of the invention, the guide plate protects shoulders of this type against contact with corrosive media. Should water or other liquids nevertheless accumulate in the region of the recess, then, for discharging into the back wall associated with the back of the recess or the lateral walls, channels, leading from the recess into the environment, can be provided for draining any liquid collecting in the recess of the guide plate. The channels can in this case be formed in a simple manner in that they are open in the direction of the underside of the guide plate.

In particular in applications in which the shoulder provided in or on the fixed substrate is suitable for being connected to a tensioning means required for tensioning the respective spring element, such as is the case for example in the shoulders of the Safelok system that are cast into the fixed substrate, it can be expedient if there is shaped into the guide plate a through-opening which leads from its upper side into the recess and through which the respectively required tensioning element can be inserted during installation for tensioning the spring element. In order to compensate for the weakening of the roof portion of the guide plate such as is caused by this opening, a respective reinforcing rib designed in the manner according to the invention can be arranged within the recess at two opposing sides of the through-opening. This arrangement of the reinforcing ribs provided in accordance with the invention allows the material thicknesses in the region of the roof portion of the guide plate to be reduced to a minimum despite the through-opening shaped therein.

On account of the stiffening and supporting of the guide plate as achieved by the ribs according to the invention, it is readily possible to make the guide plate in one piece from a plastics material. Making the guide plate from plastic not only has the advantage of a particularly low weight and simple manufacturability, but also offers good electrical insulation without this requiring additional measures. Minimum walls thicknesses with at the same time optimised stability under load are in this case obtained when the plastic is fibre-reinforced.

It is possible to further minimise the material thickness, in particular in the region of the roof portion covering the recess and carrying the spring element in the installation position, in that at least one reinforcing rib is designed even at the free upper side of the spring element. For the advantageous orientation and configuration of said reinforcing rib, the foregoing comments concerning the reinforcing ribs provided in the recess of the guide plate apply accordingly.

In addition, shaped elements, such as webs, depressions, ribs and the like, can be provided at the upper side of the guide plate according to the invention for laterally guiding, in certain portions, the spring element to be supported on the guide plate.

An embodiment of the invention that is particularly advantageous for applications requiring high electrical insulation of the rail consists in the fact that the guide plate carries, at its front side associated with the rail to be fastened, an insulator element which extends parallel to the front side and is intended to rest during installation on the foot of the rail to be fastened in such a way that the spring element applying the holding-down force acts on the rail via the insulator element. The fact that the insulator element is securely connected to the guide plate means that installation thereof is as simple as is conceivably possible and may be managed in a particularly reliable manner, including in particular with the aid of automatically operating installation machines. The secure connection between the guide plate and the insulator element can in this case be established in that the insulator element, as early as during the manufacturing process itself, is integrally connected to the guide plate, is adhesively bonded to the guide plate or attached to the guide plate. In this case, the fact that a predetermined breaking point is designed in the region of transition between the insulator element and the guide plate means that it is possible to ensure in a simple manner that the arrangement according to the invention of the insulator element does not restrict the holding-down force exerted by the spring element on the rail in the installation position. Thus, the insulator element purposefully breaks away from the guide plate if a specific loading is exceeded during tensioning of the spring element. The insulator element is then freely movable and can readily follow the movements of the rail and the spring element.

The shoulder present in or on the respective fixed substrate may, in the manner according to the invention, not only be used for supporting the guide plate itself, but can also serve as an abutment for the tensioning element used for tensioning the spring element. In order to allow this, the tensioning element in question can have a coupling portion for coupling in a form-fitting manner to the shoulder provided on the substrate. With this coupling portion, the tensioning element engages, for example, into a corresponding receptacle of the shoulder or interacts with a suitably shaped projection of the shoulder.

In order to ensure a defined flexibility of the fastening point foamed by the fastening system according to the invention, the system according to the invention can comprise an elastic intermediate layer on which the rail is positioned when the system is fully installed. This intermediate layer can be designed in such a way that it extends, when the system is fully installed, below the rail to be fastened in order to ensure a defined flexibility even in the rail.

In order to provide protection against excessive abrasive wear, it may be expedient, in particular in areas which are subject to high dust or sand drift loading, if the system according to the invention comprises an abrasion plate which is positioned on the substrate when the system is fully installed. All the other elements of the system according to the invention are then positioned on this abrasion plate which consists, for example, of a material having high abrasion resistance.

The fixed substrate, on which the guide plate according to the invention and the system according to the invention are installed, is typically formed by a concrete slab or a sleeper cast from concrete or a solid material having comparable stability under load. Likewise, the sleeper can be made from wood, plastic or steel.

The shoulder, on which the guide plate designed in accordance with the invention rests, can be designed, as in the Safelok system, as a shoulder piece which is positioned securely in the substrate with a fastening portion, while its shoulder portion protrudes freely beyond the surface of the fixed substrate.

If a respective guide plate is associated with each longitudinal side of the rail, the installation and the holding of the guide plate can be made particularly simple and secure in that the guide plates are integrally connected to one another by a portion extending below the rail in the installation position.

Furthermore, the system according to the invention can also comprise a plate which is positioned on the substrate, on which the shoulder is designed and on which the guide plate is positioned when fully installed. Plates of this type, which are referred to by experts also as "rib plates", are widely used to simplify installation and to uniformly distribute the forces occurring when the respective fastening point is traveled over.

In cases in which the shoulder to be received by the receptacle is formed in a particularly rugged or angular manner, for example as a consequence of corrosion or other wear in the region of its circumferential surfaces, it may be expedient to separately protect against abrasive wear the inner surface, facing the shoulder, of the longitudinal side wall associated with the foot of the rail to be fastened. This can be achieved by arranging at the inner surface, remote from the abutment surface, of the longitudinal side wall associated with the rail foot of the rail to be fastened a protective element which protects this inner surface from wear and is made of a material, the wear resistance of which is greater than the wear resistance of the material from which the longitudinal side wall in question is made. The object of the protective element, which is designed in particular as an insert, is to stiffen the relatively thin-walled abutment surface, so that the material of the guide plate does not work its way into the worn shoulder (anchor) of the original fastening. The protective element in question can be incorporated, for example in the form of an inlay which is connected to the guide plate in a material-uniting or form-fitting manner, directly into the longitudinal wall to be protected. A particularly economical possibility of protection results from the fact that the protective element is inserted, as a separately prefabricated component, into the receptacle of the guide plate in such a way that it abuts against the longitudinal wall to be protected. The use of a separately prefabricated protective element allows this element to be inserted when the local conditions demand this. The arrangement of a protective element protecting the longitudinal side wall has proven particularly advantageous when the guide plate is made from a plastic.

In order to protect even the roof surface of the receptacle of the guide plate against abrasive wear, it may be expedient to arrange there, too, a protective element of the type described hereinbefore in relation to the longitudinal side wall associated with the rail foot. With regard to installation, manufacture and an optimised protective effect that are as simple as possible, this can be achieved in that the protective element has a portion extending along the longitudinal side wall and at least one further portion extending along the roof surface of the recess.

The protective element may be made particularly economically from steel sheet.

BRIEF DESCRIPTION OF THE DRAWINGS

The invention will be commented on in greater detail hereinafter based on drawings which illustrate an exemplary embodiment and in which.

DETAILED DESCRIPTION OF THE EMBODIMENTS

Figure 1:
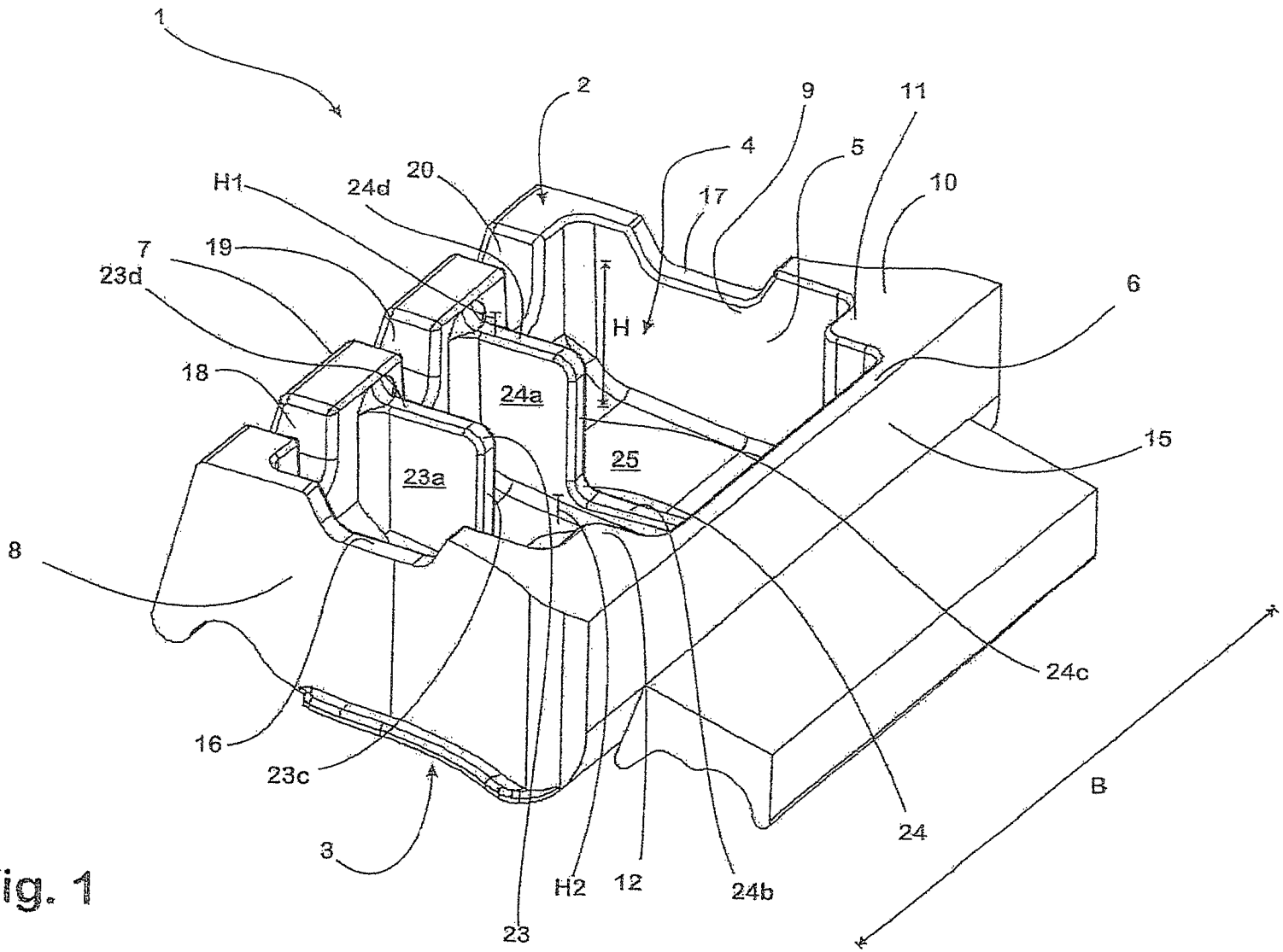
FIG. 1 is a schematic perspective view from below of a guide plate.
Figure 2:
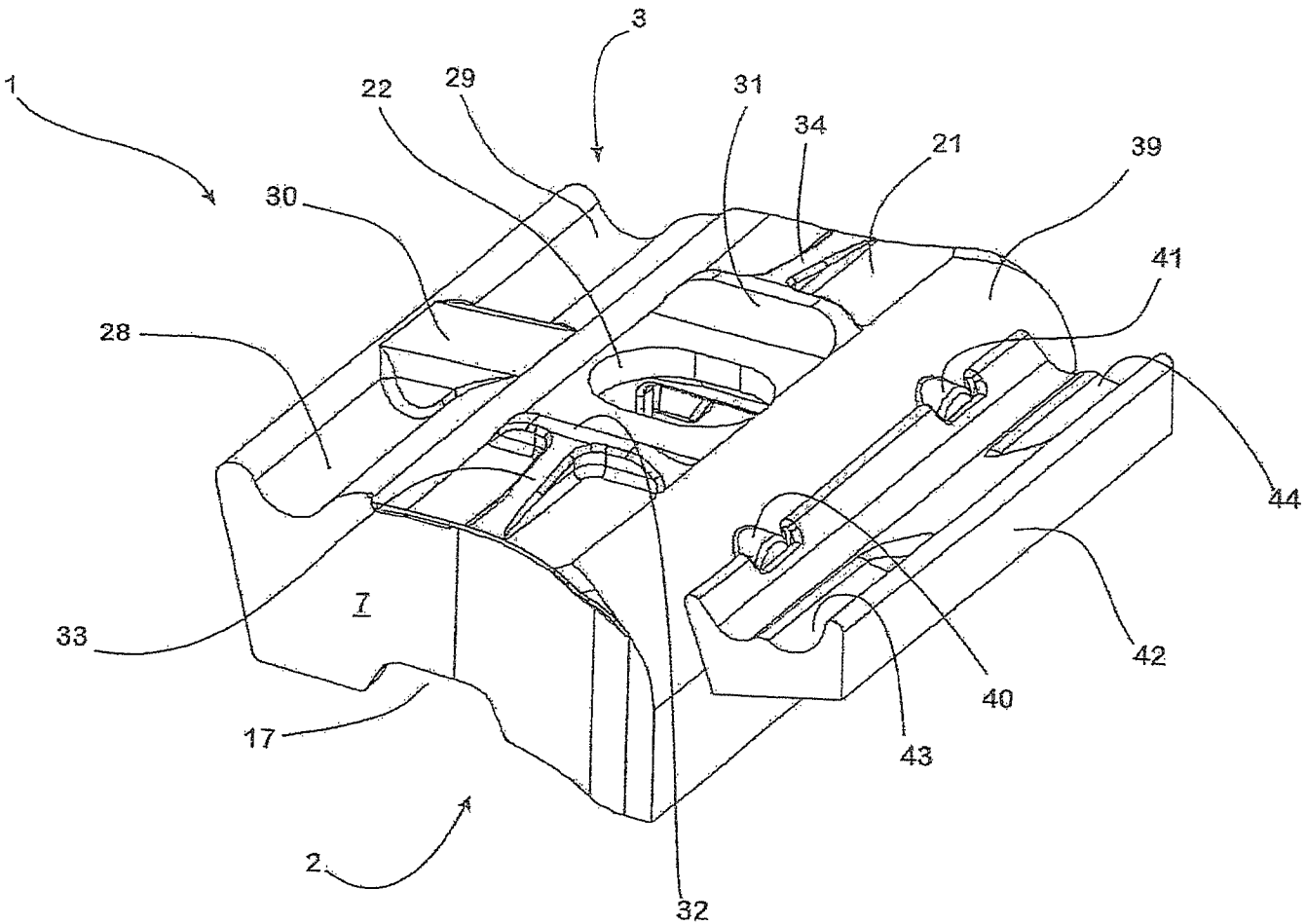
FIG. 2 is a schematic perspective view from above of the guide plate.
Figure 3:
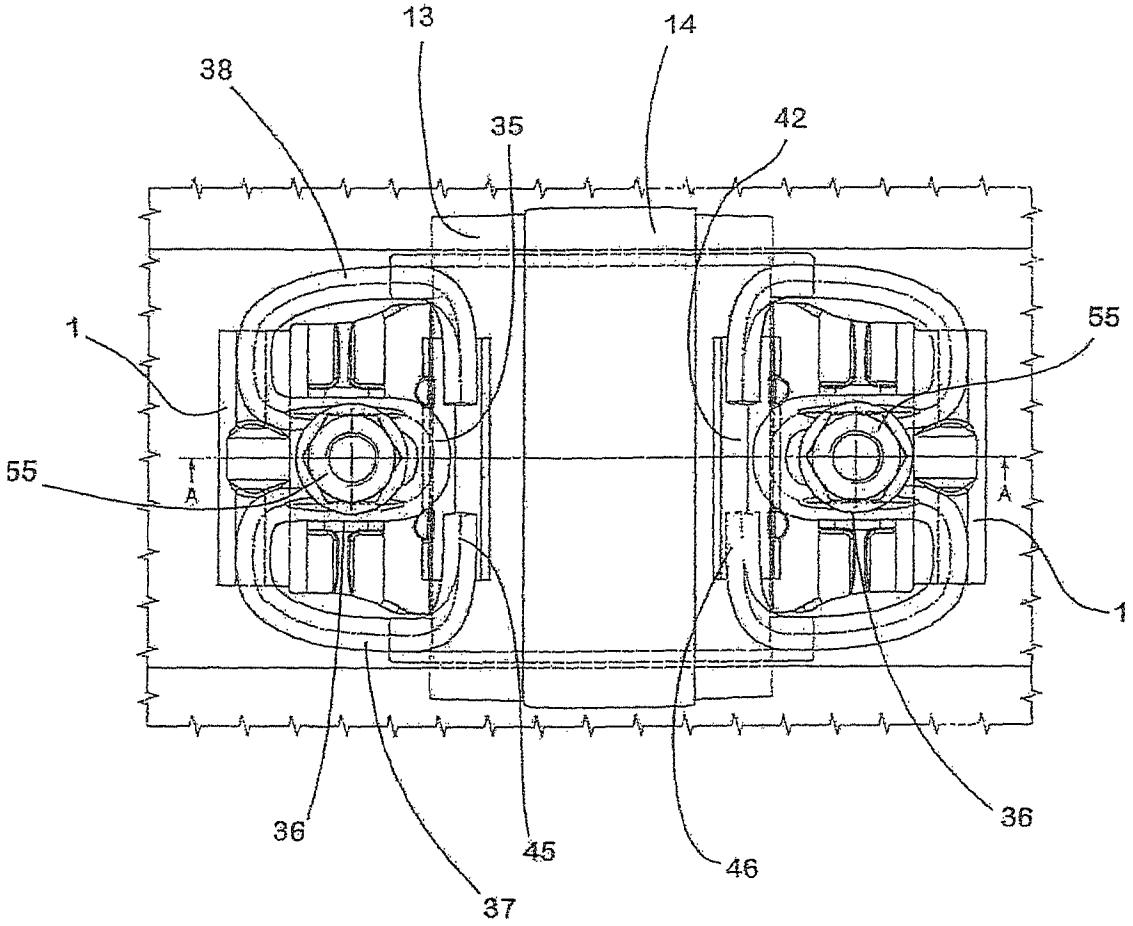
FIG. 3 is a schematic plan view of a rail fastening system.
Figure 4:
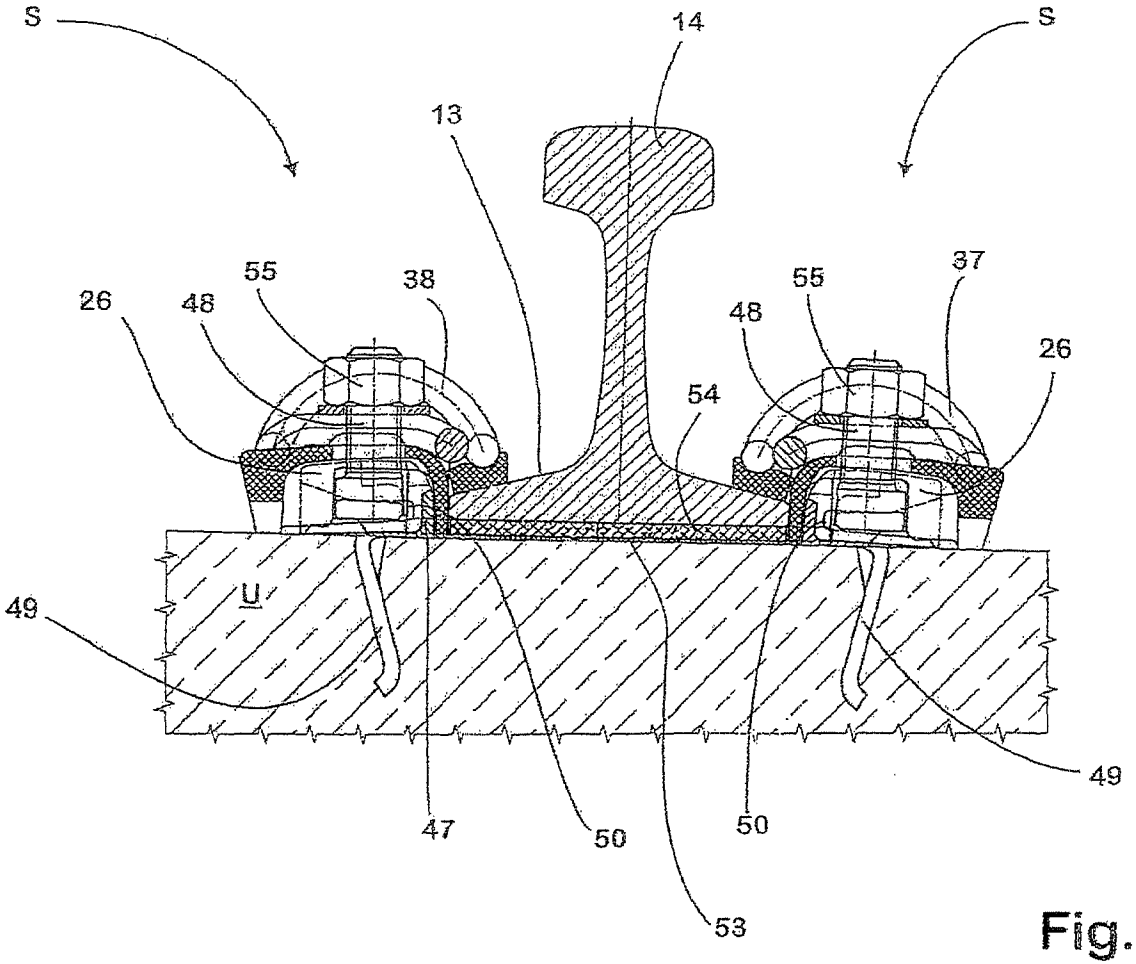
FIG. 4 is a schematic view of the rail fastening system in a section along the sectional line A-A drawn in FIG. 3.
Figure 6:
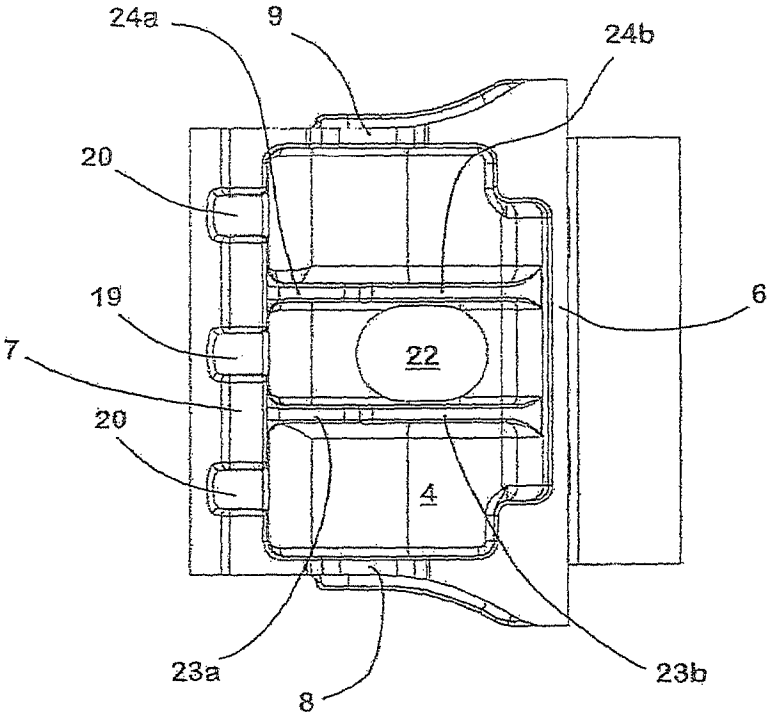
FIG. 6 is a schematic view from below of the guide plate according to FIG. 1.
Figure 5:
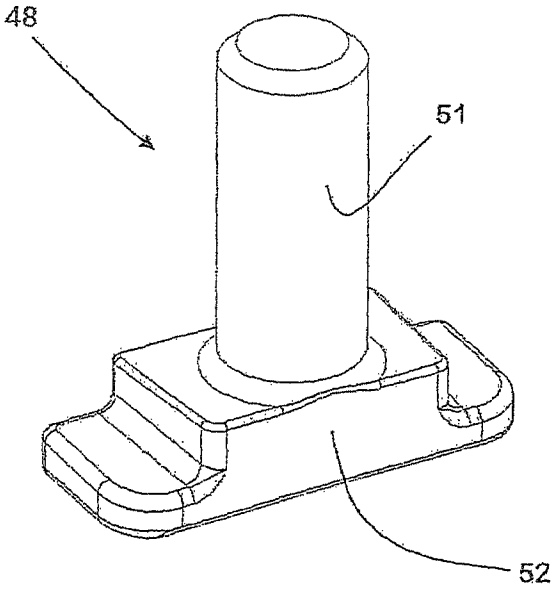
FIG. 5 is a schematic perspective view of a tensioning element inserted in the rail fastening system.
Figure 8:
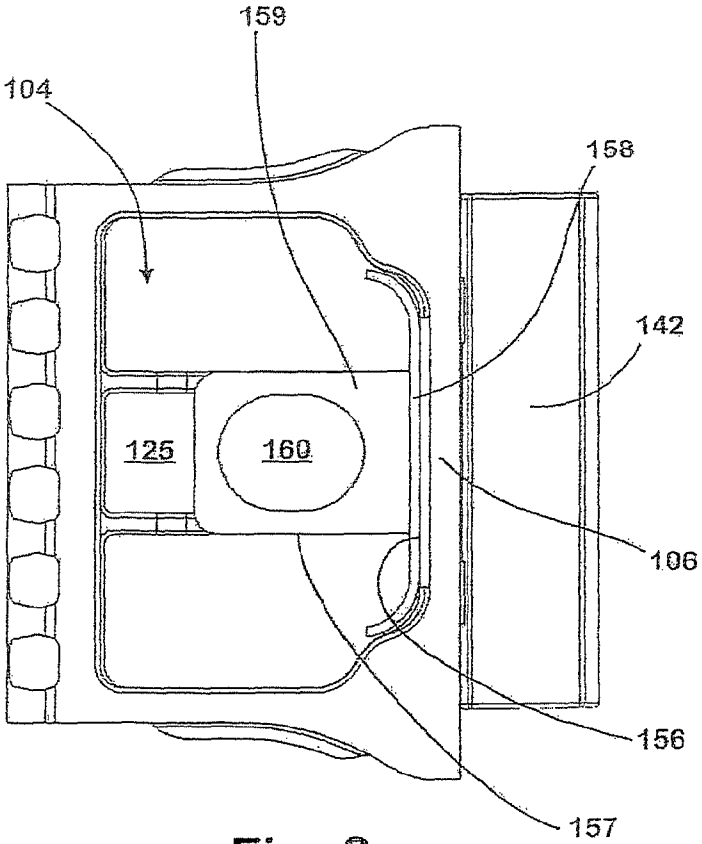
FIG. 8 is a schematic view from below of a guide plate which is inserted in the rail fastening system designed in accordance with FIG. 7 and has a protective element inserted therein.

The guide plate 1, which has the basic shape of a cuboid and is made in one piece from a fibre-reinforced plastic, has an underside 2 and an upper side 3 which is remote from the underside 2 and is exposed in the installation position.

A recess 4, the opening 5 of which takes up the vast majority of the underside 2, is shaped into the guide plate 1 from its underside 2. In this case, the recess 4 is bounded by a first longitudinal side wall 6 associated with the rail to be installed, a rearward second longitudinal side wall 7 arranged opposite thereto, a first narrow side wall 8 extending on one narrow side of the guide plate 1 and a second narrow side wall 9 which is arranged opposite thereto and is associated with the other narrow side of the guide plate 1.

The surfaces of the longitudinal sides 6, 7 and the narrow sides 8, 9 that are associated with the underside 2 form a standing surface 10 with which the guide plate 1 is positioned on the respective substrate in the installation position. In this case, a respective corner step 11, 12 protruding in the direction of the recess 4 is shaped in the corner regions between the first longitudinal side 6 and the narrow side walls 8, 9, so that an extended region of the standing surfaces 10 is provided there. At the same time, the wall thickness of the second longitudinal side 7 is greater than that of the first longitudinal side 6, so that secure supporting of the guide plate is ensured even in the region of the second longitudinal side 7.

The first longitudinal side 6 is associated with the foot 13 of the rail 14 to be installed. For this purpose, a planar abutment surface 15, which extends over the width B of the guide plate 1 and encloses a right angle with the standing surface 10, is designed at the side thereof associated with the rail foot 13. In the installation position, the rail foot 13 rests on the abutment surface 15.

A respective channel 16, 17 is shaped into the narrow side walls 8, 9, which channels 16, 17 lead from the recess 4 to the environment U and are designed so as to be open toward the standing surface 10 in the manner of recesses. Likewise, channels 18, 19, 20, which are arranged at uniform distances from one another and via which liquid (rainwater) can also flow away in the installation position of the guide plate, are shaped into the second longitudinal wall 7.

A through-opening 22, leading from the upper side 3 of the guide plate 1 into the recess 4, is shaped into the roof portion 21 of the guide plate 1 at a central location. The through-opening 22 has in this case a shape which is stretched in a groove-like manner and the longitudinal axis of which is oriented transversely to the abutment surface 15. Two reinforcing ribs 23, 24, which are each oriented transversely to the abutment surface 15, emanate from the roof surface 25 formed by the underside of the roof portion 21 of the guide plate 1 and each extend between the longitudinal side walls 6, 7 of the guide plate 1, are provided in the recess 4. One reinforcing rib 23 is in this case arranged in close proximity to one longitudinal side of the through-opening 22, whereas the other reinforcing rib 24 is positioned immediately adjacently to the other longitudinal side of the through-opening 22.

The reinforcing ribs 23, 24 each have a portion 23*a*, 24*a* which is connected to the rearward longitudinal wall 7 and extends approximately over the entire height H of the recess 4. However, said portion ends in this case at a short distance H1 from the standing surface 10, so that, in this region too, the reinforcing ribs 23, 24 do not touch the substrate on which the guide plate 1 is positioned during practical use.

Starting from the longitudinal wall 7, the respective portion 23*a*, 24*a* of the reinforcing ribs 23, 24 extends in each case over roughly one third of the depth T of the recess 4 and merges there in each case with a second portion 23*b*, 24*b* which has a much lower height H2 than in the region of its respective portion 23*a*, 24*a*. The narrow side 23*c*, 24*c* of the portion 23*a*, 24*a*, which narrow side leads to the second portion 23*b*, 24*b*, is in this case oriented at right angles to the standing surface 10 and parallel to the abutment surface 15.

The respective portion 23*b*, 24*b* extends in each case up to the longitudinal side wall 6. Within the recess 4, a free spatial volume, the shape and external dimensions of which are configured with a specific oversize in such a way that a shoulder 26, which is provided on the fixed substrate U to which the rail 14 is to be fastened, can be securely received in this free volume when this shoulder 26 is optimally oriented, is in this way delimited between the longitudinal side wall 6, the narrow sides 23*c*, 24*c* associated therewith of the portions 23*a*, 24*a* and the narrow side walls 8, 9. The dimensions of the height H2 of the portions 23*b*, 24*b* of the reinforcing ribs 23, 24 are in this case such that, when the guide plate 1 is not subjected to any loads, the underside 23*d*, 24*d* of the portions 23*b*, 24*b* and the lateral surface 23*c*, 24*c* of the portions 23*a*, 24*a* are arranged at a short distance above or laterally of the shoulder 26.

As a result of the fact that the volume of the recess 4 that is present between the portions 23*a*, 24*a* or between the respective narrow side wall 8, 9 and the associated portion 23*a*, 24*a* of the reinforcing ribs 23, 24 is also added, the guide plate 1 has a minimised mass and an accordingly minimised weight. Two flutes 28, 29, of which one emanates from the side of the guide plate 1 that is associated with the narrow side wall 8 and the other emanates from the side of the guide plate 1 that is associated with the narrow side wall 9, are shaped on the free upper side 3 of the guide plate 1, adjoining the edge associated with the rearward longitudinal side wall 7. The flutes 28, 29 are separated by a reinforcing rib 30 which is oriented, based on the abutment surface 15, centrally and transversely thereto.

In addition, two guide ribs 31, 32, of which one extends parallel to one longitudinal side and the other extends parallel to the other longitudinal side of the through-opening 22, are provided on the upper side 3 of the guide plate 1. Support portions 33, 34, extending parallel to the abutment surface 15, support the guide ribs 31, 32 on their side associated with the narrow side wall 8 and the narrow side wall 9 respectively, whereas their lateral surface associated with the through-opening 22 merges, in each case in a chamfer, with the surface surrounding the through-opening 22. When installed, the guide ribs 31, 32 support the central loop 35 of a ω-shaped spring element 36 which, with its spring arms 37, 38, exerts in a manner known per se on the rail foot the spring forces required for holding down the rail 14.

The region of transition 39 between the upper side 3 and the abutment surface 15 of the guide plate 1 is designed in a rounded-off manner. In this case, two connecting webs 40, 41, arranged set apart from each other, are moulded onto the transition region 39. At their end remote from the transition region 39, the connecting webs 40, 41 carry an insulator element 42 extending parallel to the abutment surface 15. Two flutes 43, 44, which also extend parallel to the abutment surface 15, and each emanate from the narrow side associated therewith of the insulator element 42 and are separated from each other by a centrally arranged web, are shaped into the free upper side of said insulator element 42.

The flutes 43, 44 of the insulator element 42 form receptacles in which the cranked end portions 45, 46 of the spring arms 37, 38 of the respective spring element 36 are positioned when the guide plate 1 is installed.

The connecting webs 40, 41 are designed in the manner of predetermined breaking points in such a way that they automatically break through if the force exerted on them by the spring arms 37, 38 exceeds a specific value. In this way, the insulator element 42 is automatically separated from the guide plate 1 over the course of installation.

A system S1, formed using a respective guide plate 1, for fastening the rail 14 to a substrate U, which is formed in this case by way of example by a sleeper cast from concrete, comprises, in addition to the guide plate 1 and the spring element 36, a shoulder piece 47 and a tensioning element 48. Two respective systems S1 are required for fastening the rail 14, one system S1 being arranged on one side and the other system S1 being arranged on the opposing side of the rail 14.

The shoulder 26 is formed by the portion of the shoulder piece 47 with which the shoulder piece 47 protrudes freely beyond the surface of the substrate U, whereas said shoulder piece is non-detachably cast into the substrate U with a tongue-like fastening portion 49 which is bent in an s-shaped manner. The shoulder 26 has in this case a receptacle 50 extending on the side which is remote from the rail 14 and faces the rearward longitudinal side wall 7 of the guide plate 1 parallel to the surface of the substrate U. In addition, a recess (which cannot be seen here), which emanates from the edge associated with the longitudinal side wall 7 and is arranged centrally in relation to the receptacle 50, is shaped into the upper portion of the shoulder 26 that delimits the receptacle 50 at its upper side.

The tensioning element 48, which has the basic shape of a screw bolt, has an externally threaded shank portion 51 and a coupling portion 52 which is moulded thereon and formed by two flat regions protruding, opposing each other at one end of the shank portion 51, laterally from the shank portion 51. The dimensions of the thickness of the regions in question are in this case such as to allow the coupling portion 52 to be inserted into the receptacle 50 of the shoulder 26 with slight clearance.

An abrasion plate 53 is placed onto the substrate U to provide protection from abrasive wear. In addition, an intermediate layer 54 made of elastic material is positioned on the abrasion plate 53. The rail 14 is in turn situated on the intermediate layer 54, so that said rail has a defined flexibility in the direction of the substrate U.

For installing the system S1, the tensioning element 48 is inserted with its coupling portion 52 into the receptacle 50 in such a way that the shank portion 51 of the tensioning element 48 points away from the substrate U and is positioned in that recess which is shaped into the portion of the shoulder 26 that delimits the recess 50 at its upper side.

Subsequently, the guide plate 1 is placed onto the substrate U, the shank portion 51 of the tensioning element 48 being passed through the through-opening 22. The guide plate 1 is in this case positioned in such a way that the shoulder 26 is situated in the recess 4 of the guide plate 1. The abutment surface 15 of the guide plate 1 then laterally abuts against the foot 13 of the rail 14.

When the shoulder 26 is optimally oriented, the guide plate 1 is now already positioned on the substrate U without there being any direct contact between the shoulder and the reinforcing ribs 23, 24 of the guide plate 1. However, as such optimum conditions are in practice the exception rather than the rule, it can occur that the guide plate 1, once attached, at least with a part of its reinforcing ribs 23, 24, is situated on the shoulder 26 or abuts thereagainst. In this state, the guide plate 1 is generally not yet properly positioned on the substrate U.

Once the guide plate 1 has been attached, the insulator element 42 is positioned above the rail foot 13.

The spring element 36 is now oriented on the guide plate 1 in such a way that its central loop 35 is guided between the guide ribs 31, 32 of the guide plate 1 and the bent regions of transition between the central loop 35 and the respective spring arm 37, 38 of the spring element 36 are positioned in one of the flutes 28, 29. At the same time, the cranked end portions 45, 46 of the spring arms 37, 38 are positioned in the flute 43, 44, respectively associated therewith, of the insulator element 42. Finally, a nut 55 is screwed onto the shank portion 51 of the tensioning element 48 until said nut is positioned on the central loop 35, laterally surrounding the shank portion 51, of the spring element 36. The nut 55 then in this case continues to be tightened until the spring element 36 has been tensioned to the extent that it exerts on the rail foot 13 forces required for holding down the rail 14. The guide ribs 31, 32 prevent in this case the central loop 35 from twisting.

Over the course of this tensioning process, the roof portion 21 of the guide plate 1 is if appropriate lowered until the reinforcing ribs 23, 24 are positioned on the shoulder 26.

In cases in which the guide plate 1 has, due to imprecise positioning of the shoulder 26, not yet been securely positioned on the substrate, the reinforcing ribs 23, 24 now break if appropriate, so that the space which is provided in the recess 4 and is free for receiving the shoulder 26 is automatically extended to the extent that the shoulder 26 is completely received by the recess 4 and the guide plate 1 is positioned with its standing surface 10 on the substrate U.

The connecting webs 40, 41 also break over the course of the tensioning process, so that the insulator element 42 is positioned in a freely movable manner on the rail foot 13 and the forces exerted by the spring arms 37, 38 are transmitted to the rail 14 unimpeded.

Figure 7:
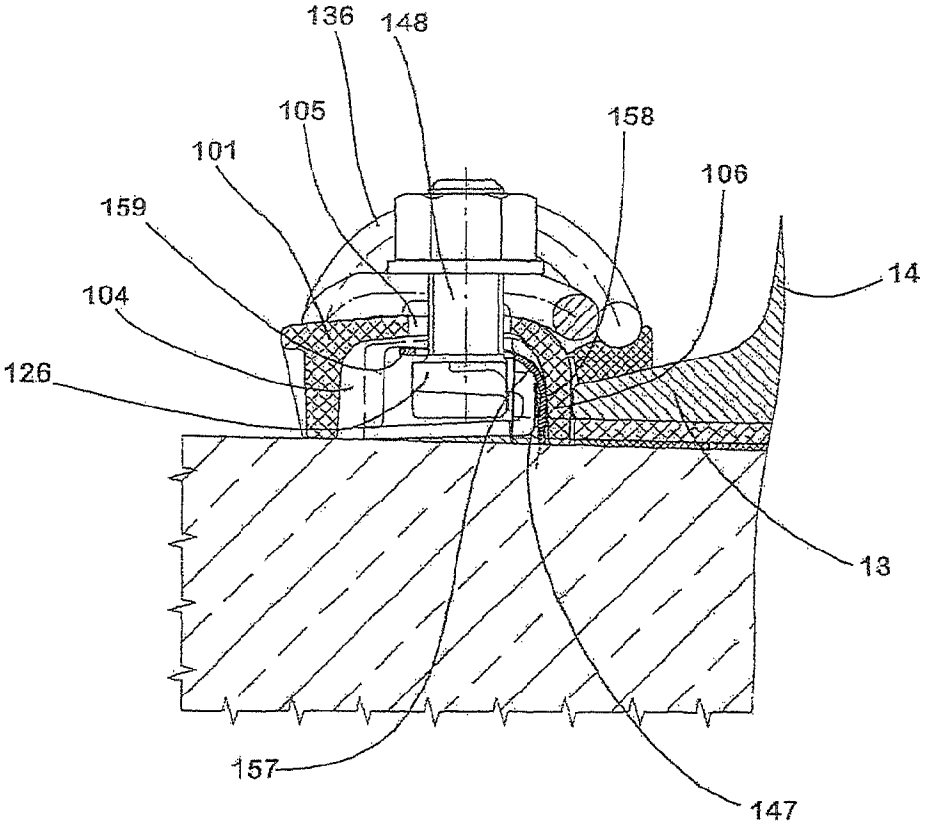
FIG. 7 is a schematic view of an alternative configuration of a rail fastening system in a section corresponding to FIG. 4.

The fastening system S2, which is illustrated in FIG. 7 in a section transversely to the longitudinal section of the rail 14 to be fastened, comprises a guide plate 101 having the same configurational features as the guide plate 1 of the system S1. Accordingly, a ω-shaped spring element 136, which exerts with the free ends of its spring arms the required holding-down force on the rail foot 13 of the rail 14 via an insulator element 142 which is moulded onto the guide plate 101 and designed in accordance with the insulator element 42, is also positioned on the guide plate 101. For this purpose, the spring element 136 is braced by means of a tensioning element 148, in the manner which has already been described hereinbefore for the tensioning element 48, against a shoulder 126 via which the guide plate 101 is placed in the manner which has already been commented on hereinbefore for the guide plate 1.

In order, even if the shoulder 126 with its shoulder piece 147 has uneven, rough surfaces as a consequence of corrosion or long use, to protect the inner surface 156 of the longitudinal side wall 106, associated with the rail foot 13, of the guide plate 101 against abrasive wear, fracture or cracks and to ensure a defined abutment surface for the longitudinal side wall 106 on the shoulder piece 147, a protective element 157, which is made from a steel sheet, is inserted into the receptacle 104 of the guide plate 101.

The protective element 157 has in this case a first portion 158 extending along and abutting tightly against the inner surface 156 of the longitudinal side wall 106 and also a second portion 159 which is moulded onto the first portion 158 and abuts against the roof surface 125 of the recess 104 of the guide plate 101. A through-opening 160, the size, shape and position of which correspond to the opening 105 of the guide plate 101, is shaped into the second portion 159 of the protective element 157. In this case, the second portion 159 of the protective element extends along the roof surface 125 in a direction directed transversely to the longitudinal side wall 106 sufficiently far that, in the event of lowering, occurring as a consequence of the installation forces, of the roof surface 125 onto the shoulder 126, even the edge region, bounding the opening 105, of the roof surface 125 of the guide plate 101 is securely protected against direct contact with the shoulder 126.

A fastening system (not shown here for the sake of clarity) corresponding to the system S2 is arranged on the opposing side of the rail foot 13.

The invention claimed is:

1. A guide plate for a system for fastening a rail to a substrate on which there is provided, laterally of the railway track, a shoulder which absorbs the forces occurring when the rail is traveled on by a rail vehicle, the guide plate comprising an underside which is associated with the substrate and an upper side, which is exposed in the installation position, is remote from the underside and on which it is possible to support a spring element provided for applying resiliently elastic holding-down forces to the rail to be fastened, wherein there is shaped into the underside of the guide plate a recess, the dimensions of which are adapted to the dimensions of the shoulder in such a way that the shoulder engages freely into the recess in the installation position of the guide plate and in that at least one reinforcing rib, which protrudes in the direction of the opening of the recess over a height which is less than the height of the recess, is designed on the roof surface of the recess that opposes the opening of the recess.

2. The guide plate according to claim 1, further comprising, at its front side associated with the rail to be fastened, a planar abutment surface for the rail foot.

3. The guide plate according to claim 2, wherein the reinforcing rib is oriented transversely to the abutment surface.

4. The guide plate according to claim 1, wherein the recess shaped into its underside is delimited, at its front associated with the rail and its back opposing the front and also the sides extending between the front and the back, in each case by a wall of the guide plate.

5. The guide plate according to claim 4, further comprising at least one channel, leading from the recess into the environment, provided in at least one of the walls for draining liquid collecting in the recess.

6. The guide plate according to claim 5, wherein the channel is open in the direction of the underside of the guide plate.

7. The guide plate according to claim 1, further comprising a through-opening which leads from its upper side into the recess and through which a tensioning element can be inserted during installation for tensioning the spring element.

8. The guide plate according to claim 7, further comprising, within the recess, a respective reinforcing rib arranged laterally of the through-opening.

9. The guide plate according to claim 1, wherein it is made in one piece from a plastic material.

10. The guide plate according to claim 9, wherein the plastic is fibre-reinforced.

11. The guide plate according to claim 1, further comprising shaped elements provided at its upper side for laterally guiding, at least in certain portions, the spring element to be supported on the guide plate.

12. The guide plate according to claim 1, wherein its upper side has at least one reinforcing rib.

13. The guide plate according to claim 1, further comprising, at its front side associated with the rail to be fastened, an insulator element which extends parallel to the front side and is intended to rest during installation on the foot of the rail to be fastened in such a way that the spring element applying the holding-down force acts on the rail via the insulator element.

14. The guide plate according to claim 13, wherein the insulator element is integrally moulded onto the guide plate and a predetermined breaking point is designed in the region of transition between the insulator element and the guide plate.

15. The guide plate according to claim 13, wherein the insulator element is designed so as to be able to be attached to the guide plate.

16. The guide plate according to claim 1, wherein there is arranged at the inner surface, remote from the abutment surface, of the longitudinal side wall associated with the rail foot of the rail to be fastened a protective element which protects this inner surface from wear, fracture or cracks and is made of a material, the wear resistance of which is greater than the wear resistance of the material from which the longitudinal side wall in question is made.

17. The guide plate according to claim 16, wherein the protective element has a portion extending along the longitudinal side wall and at least one further portion extending along the roof surface of the recess.

18. The guide plate according to claim 16, wherein the protective element is made from a steel sheet.

19. A system for fastening a rail to a substrate on which there is provided, laterally of the railway track, a shoulder, comprising a spring element for exerting an elastic holding-down force on the rail, a guide plate for guiding the spring element and a tensioning element for bracing the spring element against the substrate, wherein the guide plate is designed in accordance with claim 1.

20. The system according to claim 19, wherein the tensioning element has a coupling portion for coupling in a form-fitting manner to the shoulder provided on the substrate.

21. The system according to claim 19, wherein the shoulder of the substrate is formed by a cast part which is positioned securely in the substrate with a fastening portion.

22. The system according to claim 19, further comprising a protective element which is made of a material, the wear resistance of which is greater than the wear resistance of the material of which the longitudinal side wall, associated with the rail foot of the rail to be fastened, of the guide plate consists, which protective element can be inserted into the receptacle of the guide plate and is arranged, when inserted into the receptacle, at the inner surface, remote from the abutment surface, of one longitudinal side wall delimiting the recess.

* * * * *